US010544928B2

(12) United States Patent
Brunelli

(10) Patent No.: US 10,544,928 B2
(45) Date of Patent: Jan. 28, 2020

(54) EMERGENCY EXIT LIGHT

(71) Applicant: Hubbell Incorporated, Shelton, CT (US)

(72) Inventor: Anthony Brunelli, Piedmont, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/989,229

(22) Filed: Jan. 6, 2016

(65) Prior Publication Data

US 2016/0305637 A1 Oct. 20, 2016

Related U.S. Application Data

(60) Provisional application No. 62/149,204, filed on Apr. 17, 2015.

(51) Int. Cl.

| | |
|---|---|
| ***F21V 21/28*** | (2006.01) |
| ***F21V 21/30*** | (2006.01) |
| ***F21S 9/02*** | (2006.01) |
| ***F21V 14/02*** | (2006.01) |
| ***F21V 23/00*** | (2015.01) |
| ***F21V 33/00*** | (2006.01) |

(Continued)

(52) U.S. Cl.

CPC ..... *F21V 21/28* (2013.01); *F21S 9/022* (2013.01); *F21V 21/30* (2013.01); *F21V 14/02* (2013.01); *F21V 23/002* (2013.01); *F21V 29/773* (2015.01); *F21V 33/0076* (2013.01); *F21W 2131/107* (2013.01); *F21Y 2115/10* (2016.08)

(58) Field of Classification Search

CPC ..... F21Y 2101/02; F21Y 2115/10; F21S 2/00; F21S 4/001; F21S 8/02; F21S 8/033; F21S 8/086; F21S 48/1742; F21S 9/022; F21S 9/024; F21V 15/01; F21V 23/30; F21V 21/116; F21V 14/02; F21V 21/26; F21V 33/0076; F21V 21/28; F21V 21/30; F21V 23/002; F21V 29/773; F21V 21/15; F21V 21/29; F21M 2200/021; G09F 2013/0459; G09F 2019/225; F21W 2131/107

USPC ..... 362/234, 227, 370, 368, 812

See application file for complete search history.

(56) References Cited

U.S. PATENT DOCUMENTS 3,040,993 A * 6/1962 Schultz ..... F21V 13/00 362/269

3,772,527 A * 11/1973 Darling ..... F21S 9/022 248/73

(Continued)

FOREIGN PATENT DOCUMENTS

CN 102052587 A 5/2011

OTHER PUBLICATIONS

Unit (NAV-EM), "Instructions" May 22, 2013, entire document available from Barron technical support email <technicalsupport@barronltg.com>.

(Continued)

*Primary Examiner* — Erin Kryukova

(74) *Attorney, Agent, or Firm* — Michael Best & Friedrich, LLP

(57) ABSTRACT

An emergency lighting unit includes a housing. The housing includes a base having a first compartment and a second compartment. A first cover is positioned over the first compartment. A second cover is positioned over the second compartment. A lamp support is rotatably connected to the housing. A lamp head is rotatably connected to the lamp support.

18 Claims, 18 Drawing Sheets

(51) Int. Cl.

| | |
|---|---|
| *F21V 29/77* | (2015.01) |
| *F21Y 115/10* | (2016.01) |
| *F21W 131/107* | (2006.01) |

(56) References Cited

U.S. PATENT DOCUMENTS

| | | | | |
|---|---|---|---|---|
| 3,983,386 | A * | 9/1976 | Schallenkammer | F21S 6/002 362/427 |
| 4,355,479 | A * | 10/1982 | Thornton | G09F 7/18 40/488 |
| 4,410,933 | A * | 10/1983 | Blake | F16M 11/10 248/282.1 |
| 4,701,833 | A * | 10/1987 | Bornhorst | F21V 21/30 362/294 |
| 5,473,517 | A * | 12/1995 | Blackman | F21S 9/022 200/312 |
| 5,513,085 | A * | 4/1996 | Bourne | F21S 8/022 362/274 |
| 5,797,673 | A * | 8/1998 | Logan | G09F 13/04 362/20 |
| 5,911,499 | A | 6/1999 | Stafford et al. | |
| 5,938,317 | A * | 8/1999 | Thornton | F21V 11/02 362/290 |
| 6,142,649 | A * | 11/2000 | Beghelli | F21S 9/022 362/259 |
| 6,273,585 | B1 * | 8/2001 | Wu | F21V 21/30 362/135 |
| 6,309,085 | B1 * | 10/2001 | Katz | F21V 21/116 248/222.11 |
| 6,481,871 | B2 * | 11/2002 | Jamison | F21V 21/30 362/287 |
| 6,606,808 | B2 * | 8/2003 | Katz | G09F 13/04 362/234 |
| 6,741,324 | B1 * | 5/2004 | Kim | G09F 19/22 362/235 |
| 7,390,110 | B2 * | 6/2008 | Katz | F21V 21/30 362/382 |
| D648,469 | S * | 11/2011 | Martineau | D26/51 |
| 8,911,134 | B2 * | 12/2014 | Hsu | G08B 7/062 362/613 |
| 8,960,976 | B2 * | 2/2015 | Georgitsis | F21V 21/30 362/417 |
| 8,998,473 | B1 * | 4/2015 | Anderson | A01G 7/045 362/253 |
| 9,080,747 | B1 * | 7/2015 | Hetrick | F21V 14/06 |
| 2004/0233676 | A1 * | 11/2004 | Matts | F16C 11/103 362/418 |
| 2005/0094385 | A1 * | 5/2005 | Lee | F21L 4/04 362/98 |
| 2006/0072304 | A1 | 4/2006 | Lay et al. | |
| 2006/0215403 | A1 * | 9/2006 | Martineau | G09F 13/04 362/240 |
| 2008/0030998 | A1 * | 2/2008 | Tsai | F21V 21/06 362/382 |
| 2008/0276509 | A1 * | 11/2008 | Yu | F21V 23/04 40/570 |
| 2008/0291677 | A1 * | 11/2008 | Chen | F21V 15/01 362/249.01 |
| 2009/0237934 | A1 * | 9/2009 | Zeng | F21V 21/30 362/249.03 |
| 2011/0023339 | A1 * | 2/2011 | Mirica | G09F 7/18 40/564 |
| 2011/0103037 | A1 * | 5/2011 | Liu | F21L 4/00 362/20 |
| 2012/0033434 | A1 * | 2/2012 | Wang | F21S 8/033 362/366 |
| 2012/0057352 | A1 * | 3/2012 | Wilcox | F21V 29/70 362/308 |
| 2012/0174448 | A1 * | 7/2012 | Lee | F21V 33/0076 40/570 |
| 2012/0287613 | A1 * | 11/2012 | Hamel | F21V 29/004 362/184 |
| 2013/0050996 | A1 | 2/2013 | Holscher et al. | |
| 2015/0198310 | A1 * | 7/2015 | Scarlata | F21V 29/507 362/249.01 |

OTHER PUBLICATIONS

Barron Exitronix, "NAV-EM Series." Barron Lighting Group, Jun. 2013, entire document [online] URL=<http://barronltg.com/exitronix-products.php?page=nav-em>.

PCT/US2016/012332 International Search Report and Written Opinion dated Jun. 2, 2016.

Chinese Patent Application No. 201680029304.8 First Office Action Issued by China National Intellectual Property Administration dated Apr. 26, 2019 and translation (11 pages).

* cited by examiner

EMERGENCY EXIT LIGHT

RELATED APPLICATION(S)

This application is based on U.S. provisional application Ser. No. 62/149,204, filed Apr. 17, 2015, the disclosure of which is incorporated herein by reference in its entirety and to which priority is claimed.

FIELD

Various exemplary embodiments relate to lighting devices, for example emergency exit lighting.

BACKGROUND

Emergency units, such as exit signs and light fixtures, are commonly used in public buildings to indicate and illuminate areas such as stairs and exits in the event of a power failure. These fixtures typically have an emergency backup power system such as a battery that automatically turns on the emergency light when the primary power source is interrupted. Emergency lighting units are used in a number of commercial and residential settings.

SUMMARY

According to an exemplary embodiment, an emergency lighting unit includes a housing. The housing includes a base having a first compartment and a second compartment. A first cover is positioned over the first compartment. A second cover is positioned over the second compartment. A lamp support is rotatably connected to the housing. A lamp head is rotatably connected to the lamp support.

According to another embodiment, a lamp assembly includes a lamp support having a stem, a first arm, and a second arm. A lamp head is rotatably connected to the first and second arms. A first conductor passes from the first arm into the lamp head and a second conductor passes from the second arm into the lamp head.

According to another exemplary embodiment, a lamp assembly for a lighting unit includes a lamp head and a light emitter. The lamp head includes a body, a front cover and a back cover. The body includes a front side and a back side. The front cover is connected to the front side of the body and the back cover is connected to the back side of the body. The light emitter assembly is positioned in the body.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
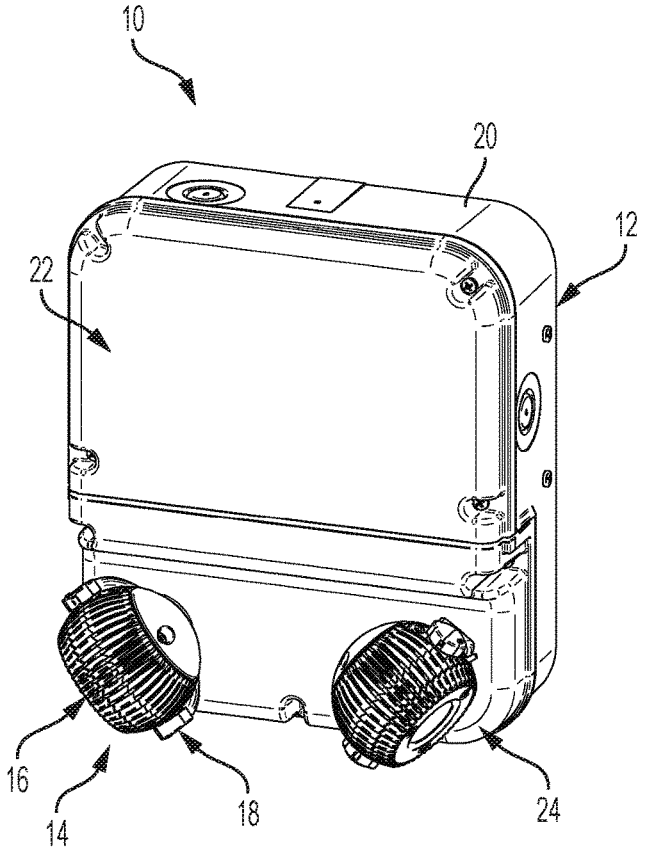
FIG. 1 is a perspective view of an exemplary lighting unit.
Figure 2:
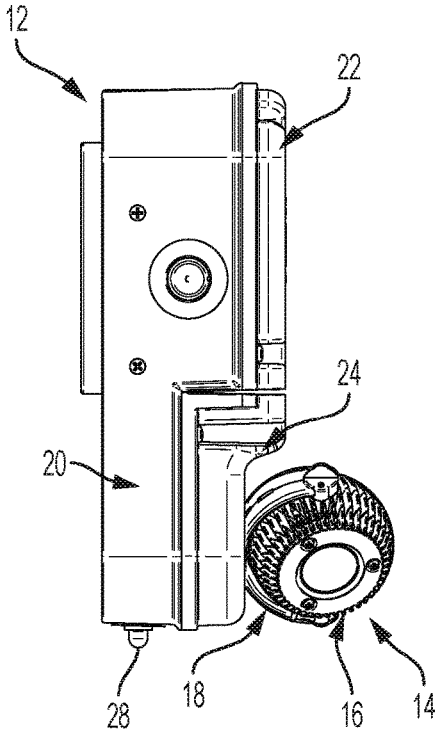
FIG. 2 is a side view of the lighting unit of FIG. 1.
Figure 3:
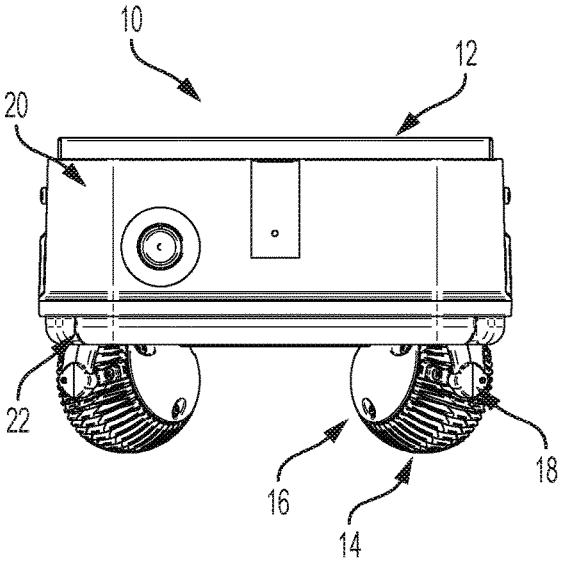
FIG. 3 is a top view of the lighting unit of FIG. 1.
Figure 4:
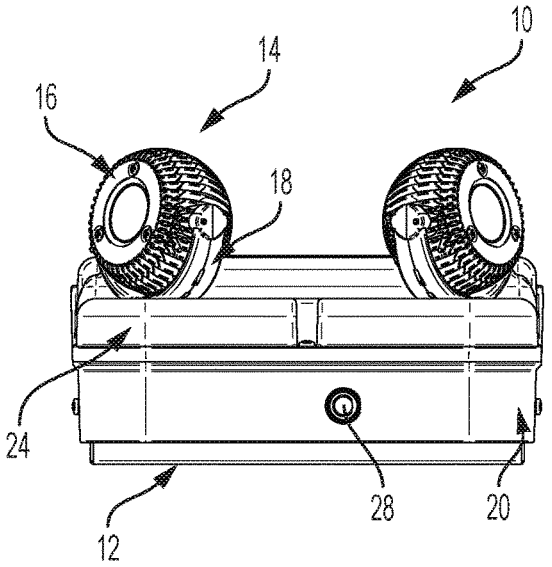
FIG. 4 is a bottom view of the lighting unit of FIG. 1.

Various exemplary embodiments are directed to a lighting system, for example, an emergency lighting unit 10 having a housing 12 and a lamp assembly 14. The lamp assembly 14 includes a lamp head 16 and a lamp support 18. The lamp assembly 14 is connected to and/or extends from a lower portion of the housing 12 and is adjustable with respect to the housing 12, allowing light emitted from the lamp assembly 14 to be aimed at a desired location.

Figure 5:
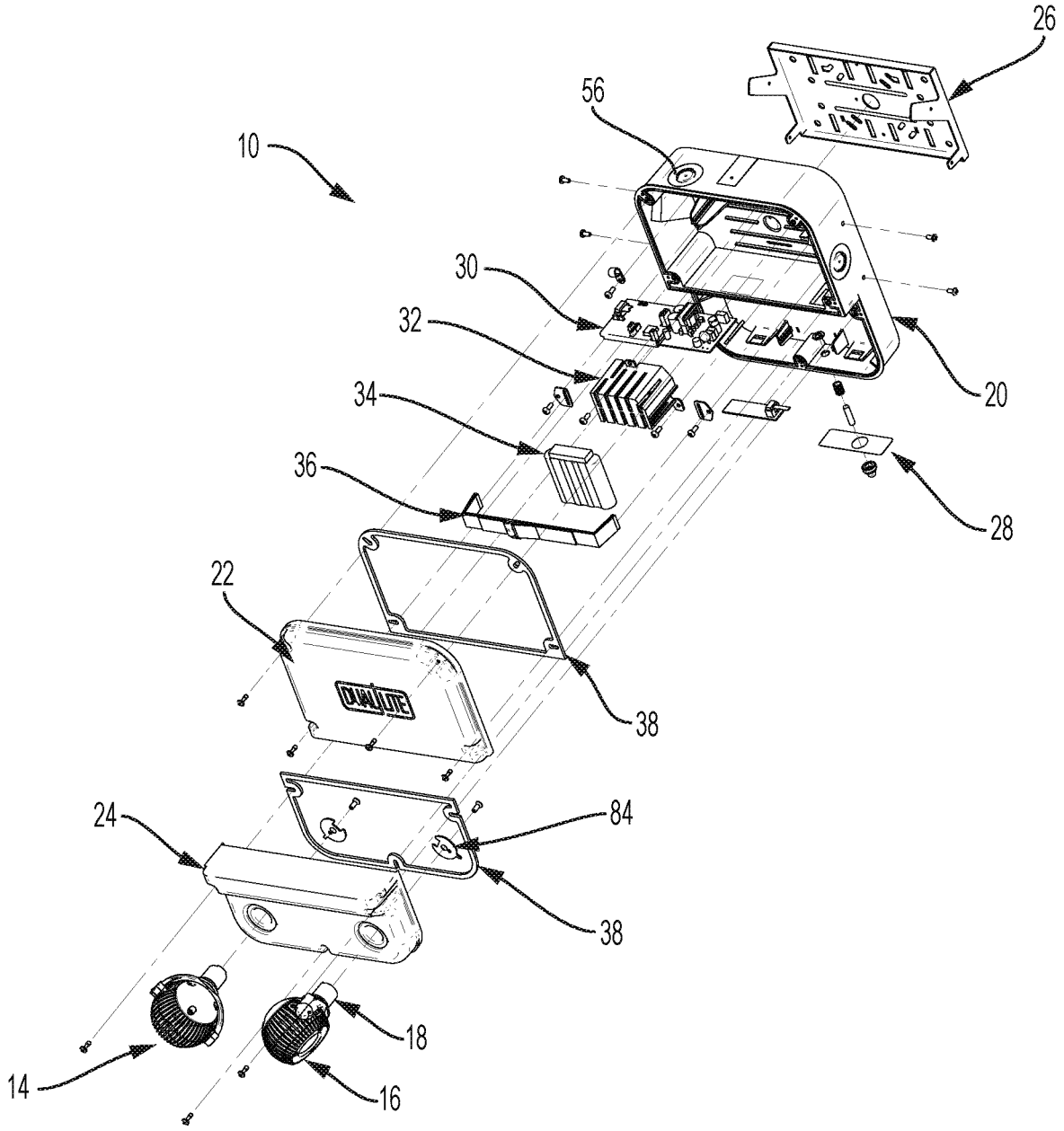
FIG. 5 is an exploded view of the lighting unit of FIG. 1.

FIGS. 1-4 show an exemplary embodiment of the housing 12 having a base 20, an upper cover 22, and a lower cover 24. The lamp assembly 14 extends from the lower cover 24. A mounting bracket 26 can connect to the base to assist in securing the housing 12 to a variety of structures. In an exemplary embodiment, a test button 28 or switch extends from a lower portion of the housing 12. The test button 28 can be connected to a secondary circuit and include a light pipe to provide illumination or a signal to a user. For example a secondary circuit can be programmed to provide a certain number or pattern of continuous and/or blinking lights to indicate the status of the lighting unit 10. The base 20 can be a single piece unit that forms a partial enclosure for the inner components of the lighting assembly 10. As best shown in FIG. 5, an example of the internal components can include a circuit 30 that controls the charging and operation of the lighting unit, a circuit cover 32, a battery 34, and a strap 36 to hold the battery 34 in place. One or more gaskets or seals 38 can also be positioned between the housing 12 and the covers. The exact number, type, and configuration of inner components can vary depending on the lighting assembly, the intended location, and the intended operation as would be understood by one of ordinary skill in the art. A description of the housing is based on the illustrated embodiments, however, different sizes, shapes, and configurations may be used.

Figure 6:
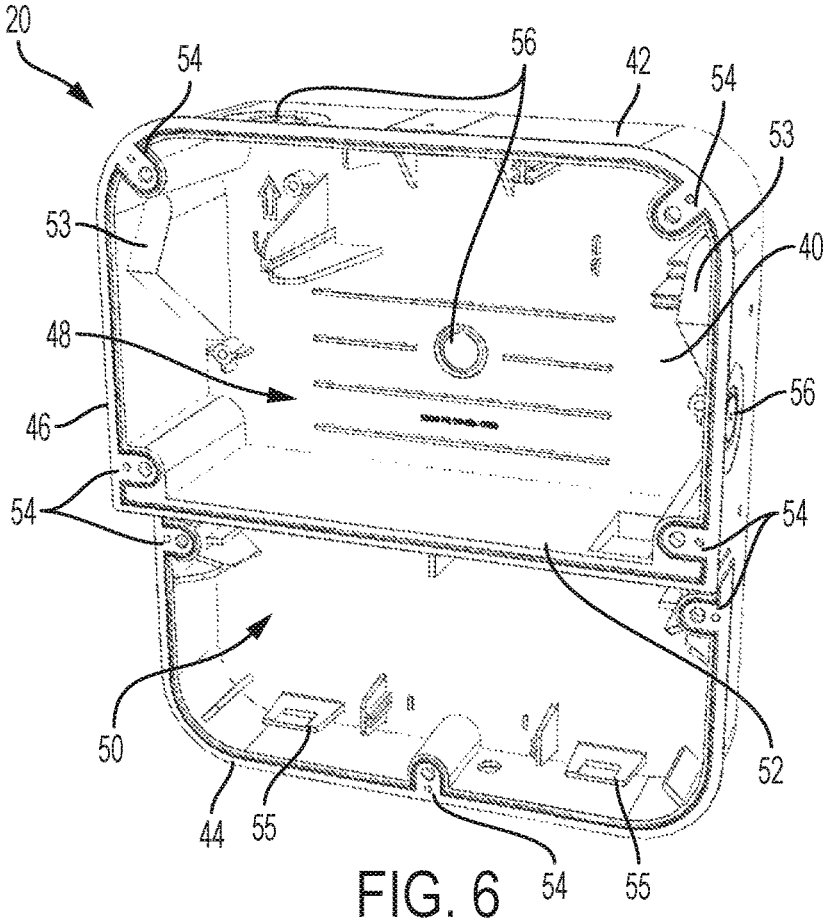
FIG. 6 is a perspective view of an exemplary housing.
Figure 7:
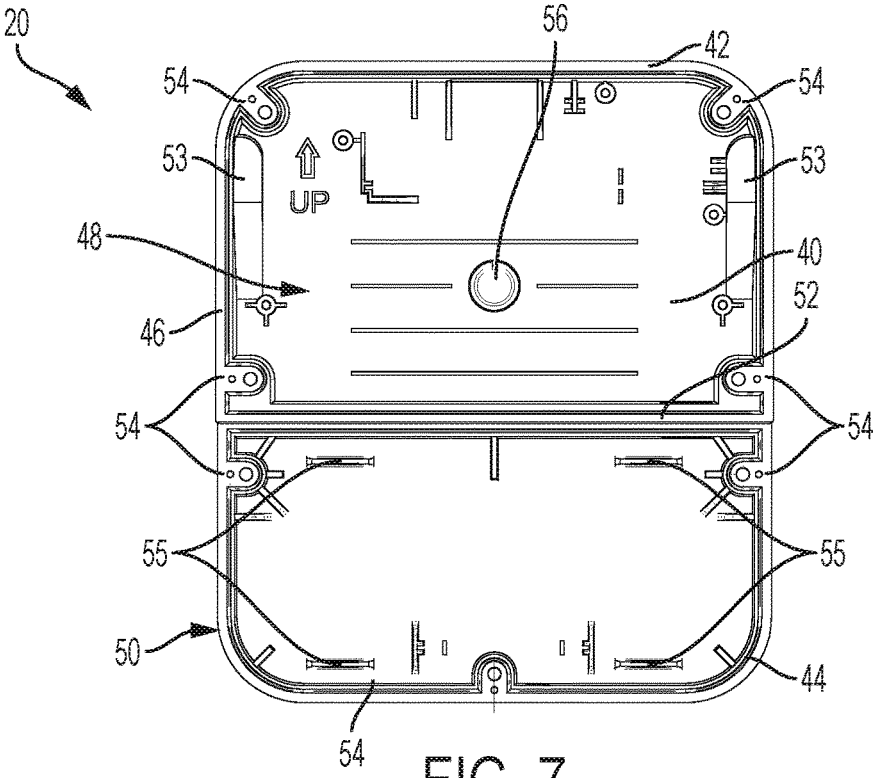
FIG. 7 is a front view of FIG. 6.
Figure 8:
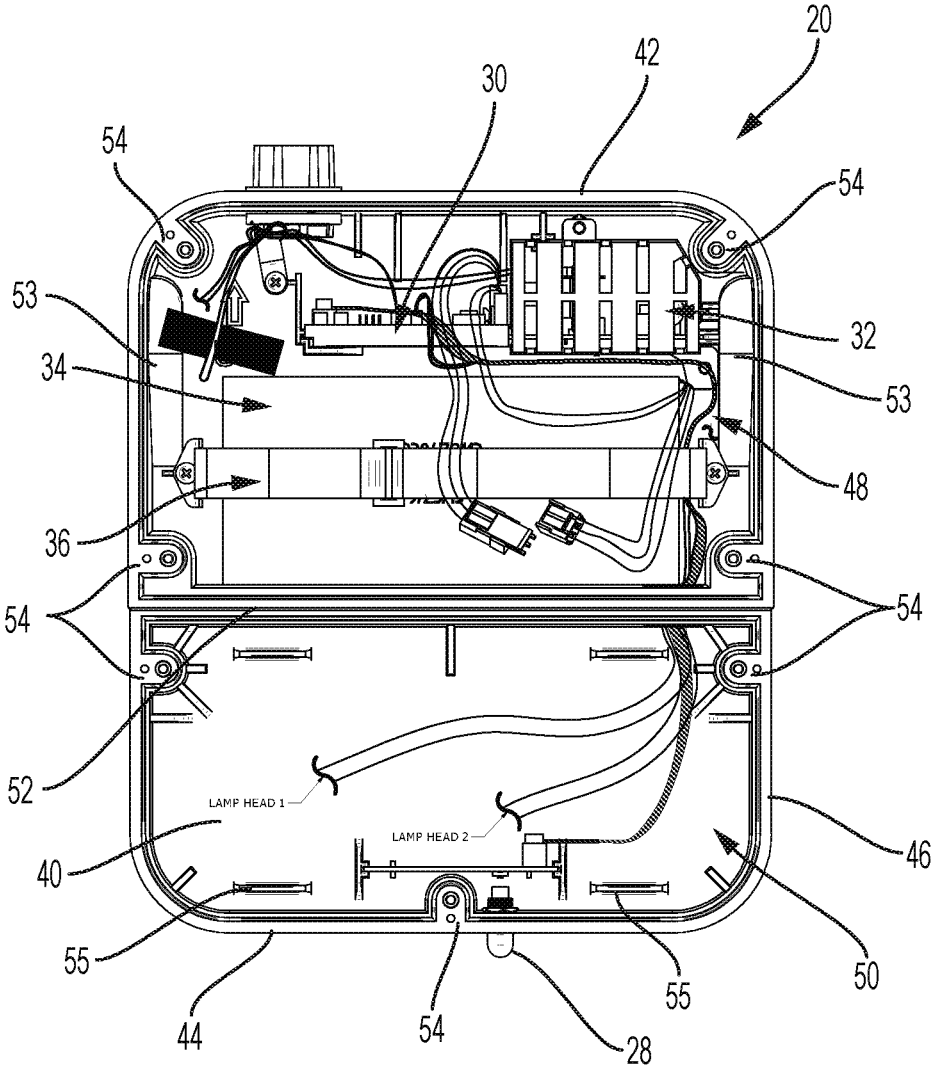
FIG. 8 is a front view of FIG. 6 showing an exemplary wiring configuration.

As best shown in FIGS. 6 and 7, the base 20 includes a back wall 40, a top wall 42, a bottom wall 44, and a pair of side walls 46 surrounding a first compartment 48 and a second compartment 50. The first compartment 48 houses a number of internal components, for example the battery 34 and circuitry 30. The second compartment 50 is separated from the first compartment 48 and includes the connection to the lamp assemblies 14. One or more dividing walls 52 separate the first and second compartment 48, 50. The base 20 can be molded as a single unitary structure with continuous top 42, bottom 44, and side walls 46, or it can be formed of different pieces that are separately connected. The first and second compartments 48, 50 include a plurality of support and/or connection features that assist in engaging and/or retaining the additional components of the emergency lighting assembly 10. For example, side protrusions 53 can be formed in the housing having corresponding depressions in the back of the base 20 to receive a portion of the mounting bracket 26. The side protrusions 53 have angled walls and a substantially trapezoidal configuration. A plurality of mounting posts 54 having a first opening for receiving a fastener and a second open for receiving a protrusion are also positioned around the housing 20. The mounting features can also include one or more clips 55, for example a pair of top clips and a pair of bottom clips, that can engage components connected to the lower compartment 50. The base 20 also includes one or more knockouts 56 that can be selectively removed to assist with running conductors into the housing 12. For example the back wall 40, top wall 42, and at least one of the side walls 46 can include a knock out 56. FIG. 8 shows an example of the wiring connections that can be made in the first and second compartments 48, 50.

Figure 9:
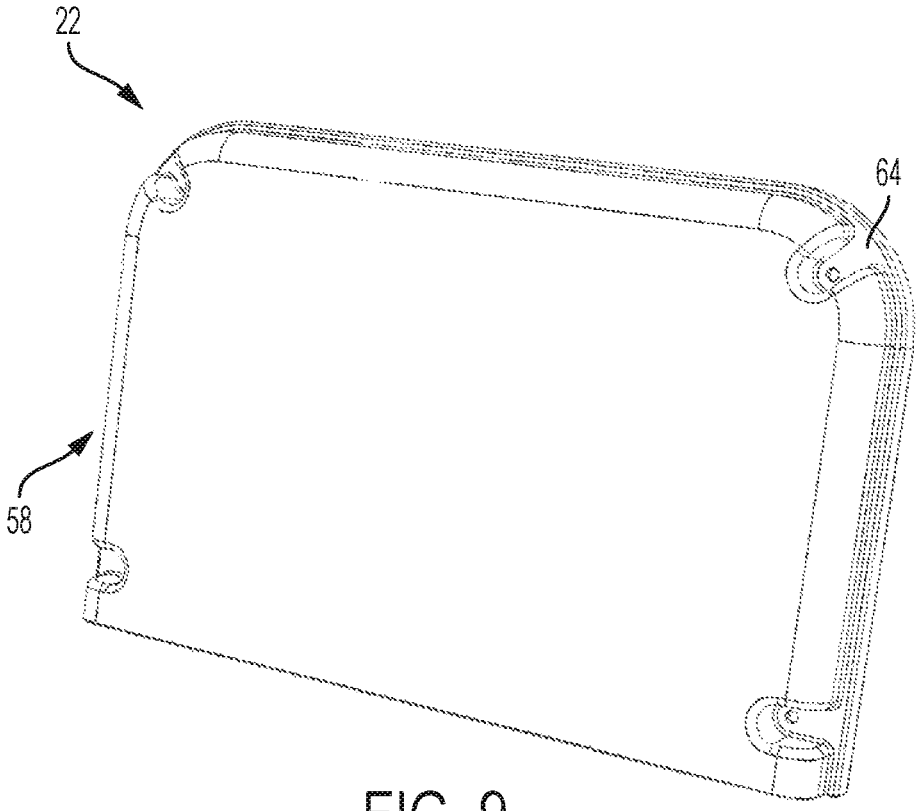
FIG. 9 is a front perspective view of an exemplary upper cover.
Figure 10:
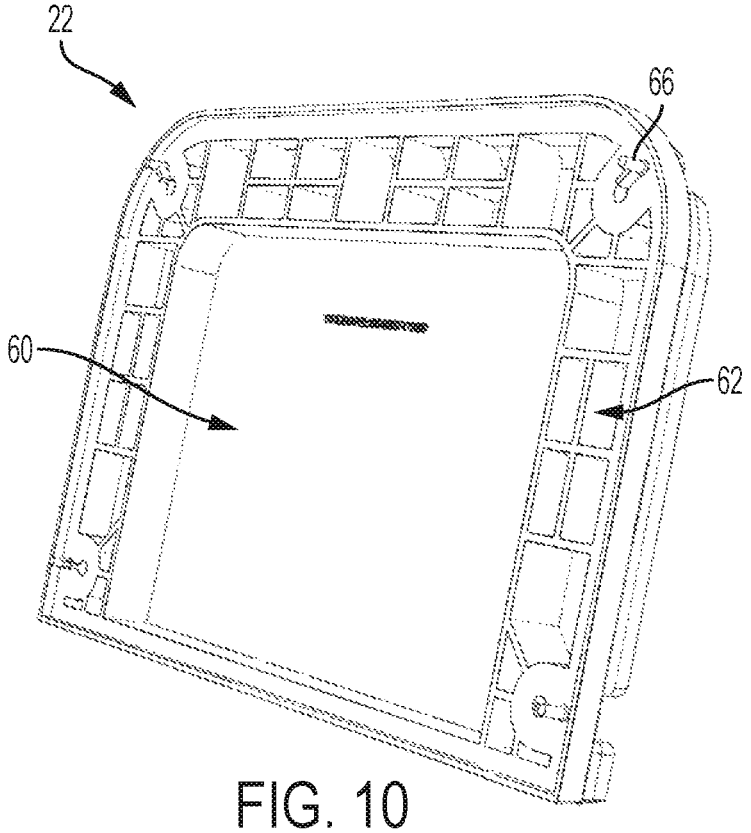
FIG. 10 is a back perspective view of FIG. 9.

FIGS. 9 and 10 show an exemplary embodiment of the upper cover 22 having an outer surface 58 and an inner recess 60. The inner recess 60 provides additional space for the interior components. A grid 62 extends around the inner recess 60 to provide additional strength to the upper cover 22. Slots 64 are formed in the outer surface 58 around openings extending through the upper cover 22 to receive fasteners that connect the upper cover 22 to the base 20. One or more projections 66 extend from the back of the top cover that align with the second openings of the base mounting posts 54.

Figure 11:
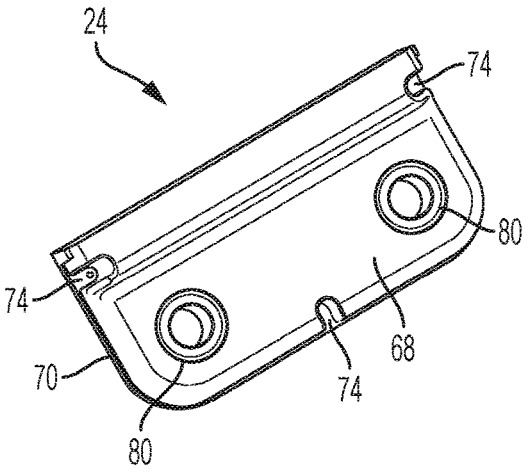
FIG. 11 is a front perspective view of an exemplary lower cover.
Figure 12:
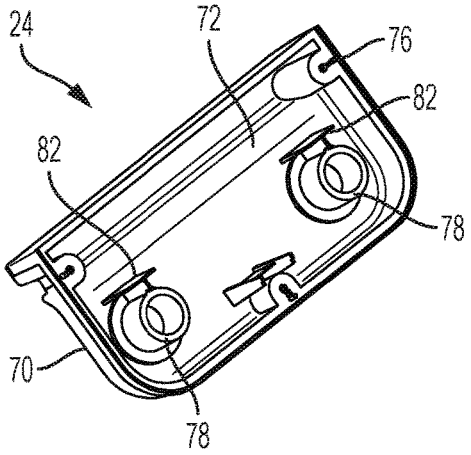
FIG. 12 is a back perspective view of FIG. 11.

FIGS. 11 and 12 show an exemplary embodiment of the lower cover 24 having an outer surface 68 and an outer wall 70 surrounding an inner recess 72. Slots 74 are formed in the outer surface 68 around openings extending through the lower cover 24 to receive fasteners that connect the lower cover 24 to the base 20. One or more projections 76 extend from the back of the lower cover 24 to align with the second openings of the base 20 mounting posts 54. First and second shaft openings 78 are provided in the lower cover 24 having a cylindrical wall that extends into the inner recess 72. The shaft openings 78 rotatably receive the lamp assemblies 14. A groove 80 is formed in the outer surface 68 around each of the shaft openings 78. In an exemplary embodiment the lower cover 24 is NEMA 4× and wet location rated.

Figure 13:
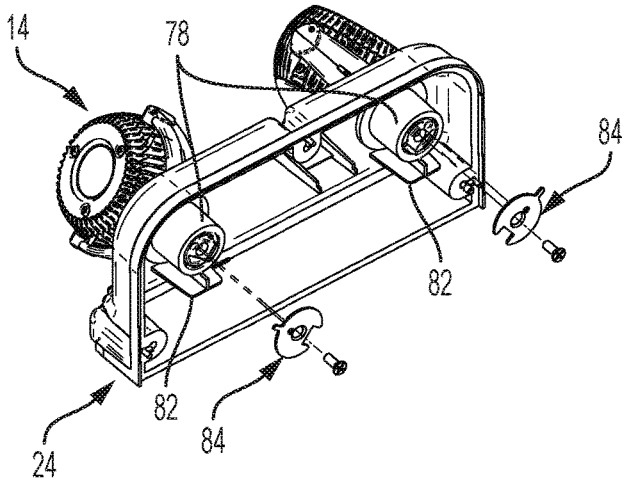
FIG. 13 is a back perspective of an exemplary lower cover and lamp assembly.
Figure 14:
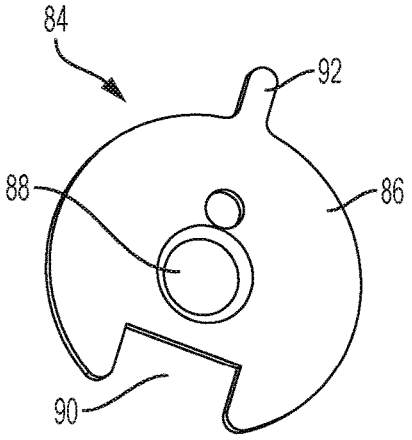
FIG. 14 is a front perspective view of an exemplary anti-rotation bracket.
Figure 15:
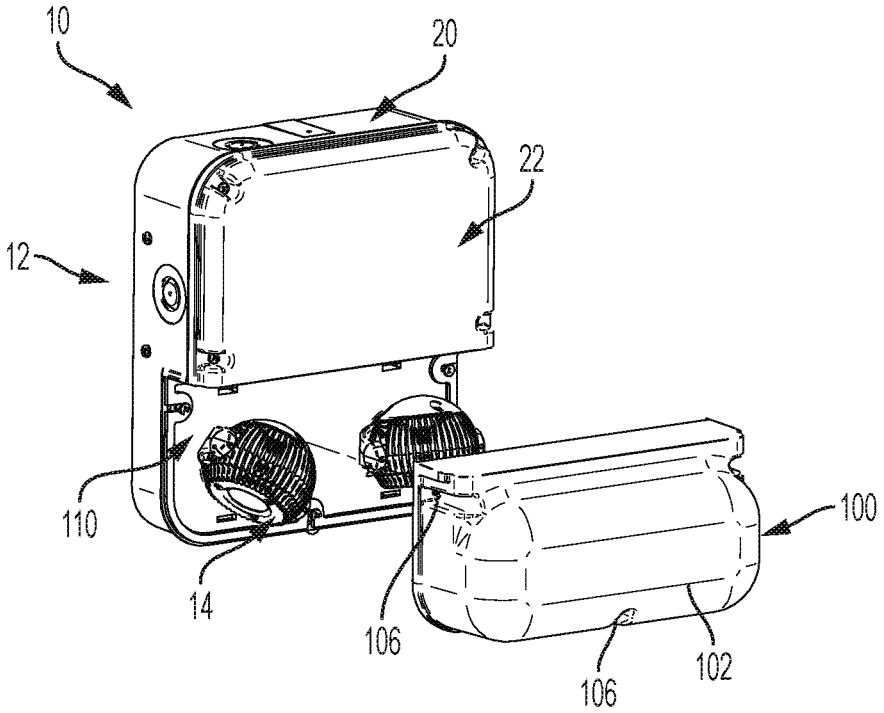
FIG. 15 is a partially exploded view of an exemplary lighting unit with an exemplary second lower cover.
Figure 16:
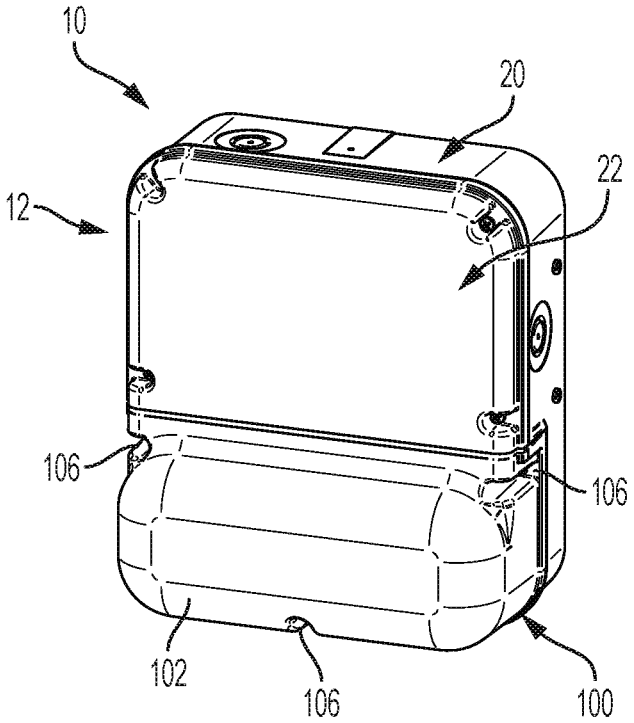
FIG. 16 is a front perspective view of FIG. 15 with the second lower cover attached.
Figure 17:
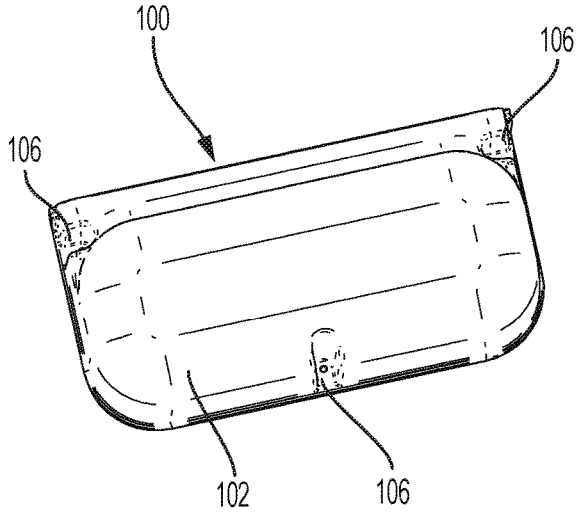
FIG. 17 is a front perspective view of the lower cover of FIG. 15.
Figure 18:
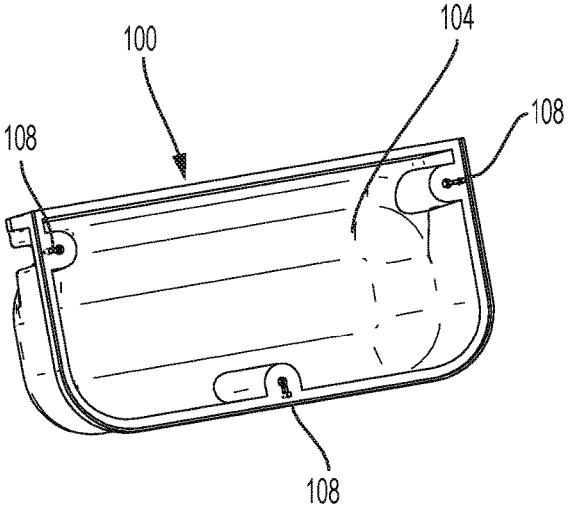
FIG. 18 is a back perspective view of the lower cover of FIG. 15.
Figure 19:
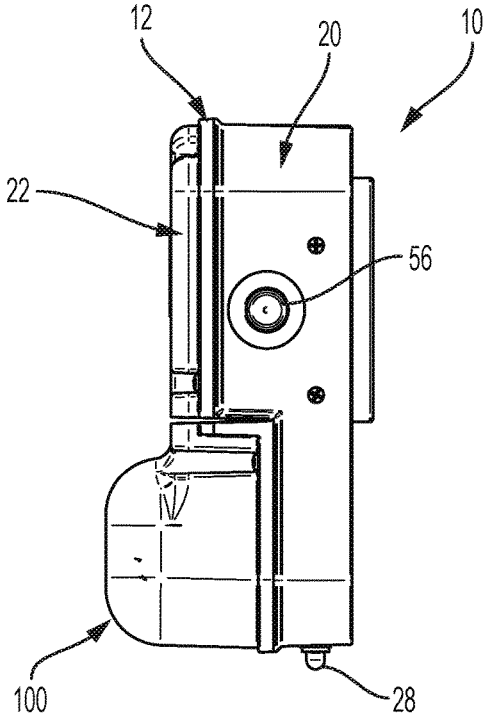
FIG. 19 is a right side view of FIG. 15.
Figure 20:
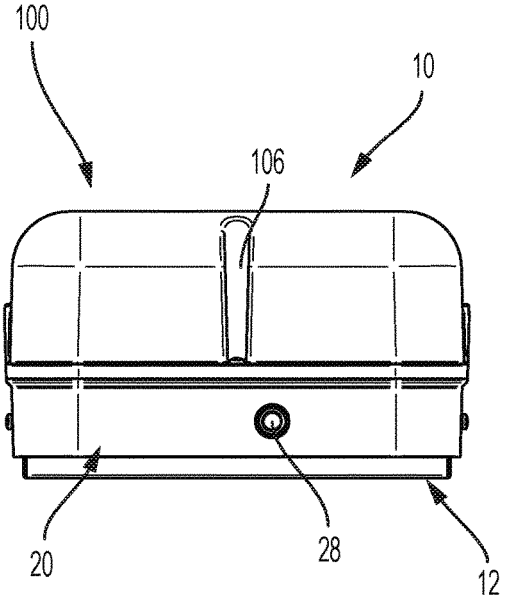
FIG. 20 is a bottom view of FIG. 15.

In an exemplary embodiment, a stop 82, for example a substantially T-shaped projection, extends from the shaft openings 78. When the light assemblies 14 are connected to the lower cover 24, an anti-rotation bracket 84 is used to limit rotation of the lamp assemblies 14 in the shaft openings 78. As shown in FIGS. 13 and 14, an exemplary anti-rotation bracket 84 includes a disk member 86 having a fastener opening 88, a conductor opening 90, and a projection 92. A fastener extends through the fastener opening 88 to connect the anti-rotation bracket 84 to the lamp assembly 14 through the shaft opening 78. The anti-rotation bracket 84 rotates with the lamp assembly 14 until the projection 92 engages the stop 82. The anti-rotation bracket 84 prevents over rotation of the lamp assemblies 14 in the shaft openings 78 to help prevent conductors from becoming damaged or tangled.

FIGS. 15-21 depict an exemplary embodiment of a second lower cover 100 that can be used, for example in food processing locations. The second lower cover 100 includes an outer surface 102 surrounding an inner recess 104. The inner recess 104 receives the lamp assemblies 14. Slots 106 are formed in the outer surface 102 around openings to receive fasteners that connect the second lower cover 100 to the base 20. One or more projections 108 extend from the back of the second lower cover 100 that align with the second openings of the base mounting posts 54. The second lower cover 100 is formed from a substantially clear material, for example a clear polymer such as polycarbonate.

Figure 21:
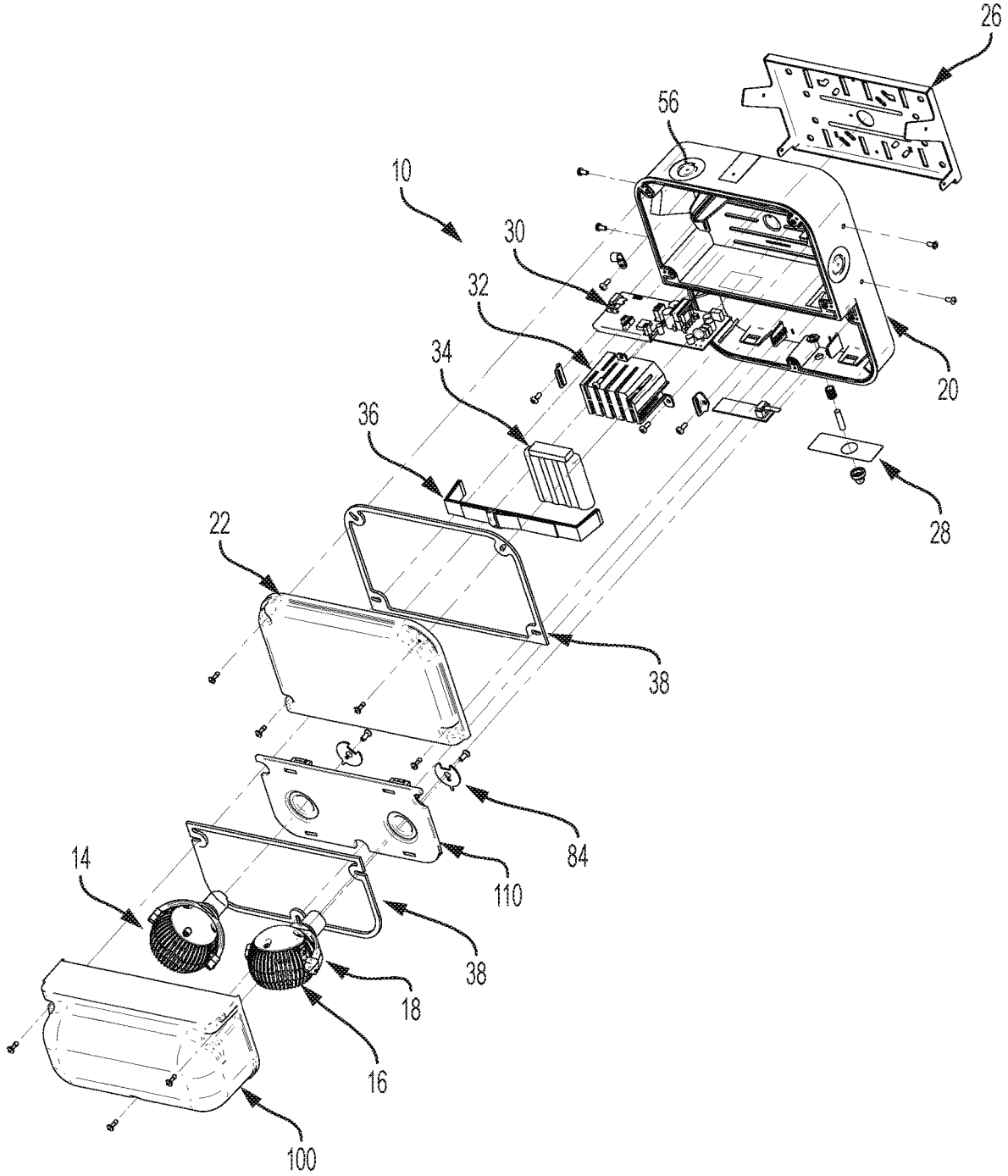
FIG. 21 is an exploded view of FIG. 15.
Figure 22:
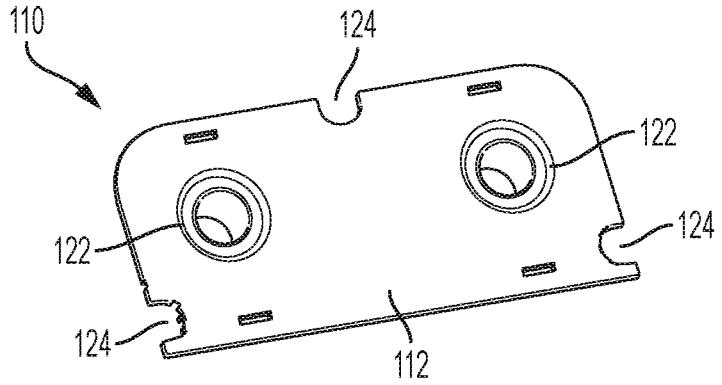
FIG. 22 a front perspective view of an exemplary mounting plate.
Figure 23:
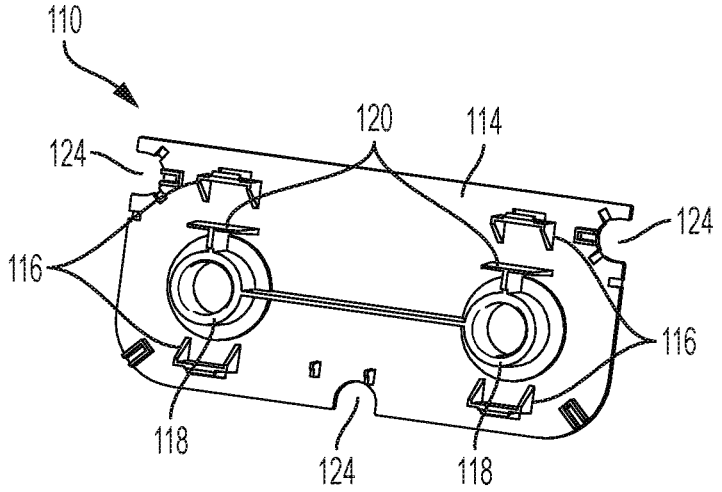
FIG. 23 is a back perspective view of FIG. 22.
Figure 24:
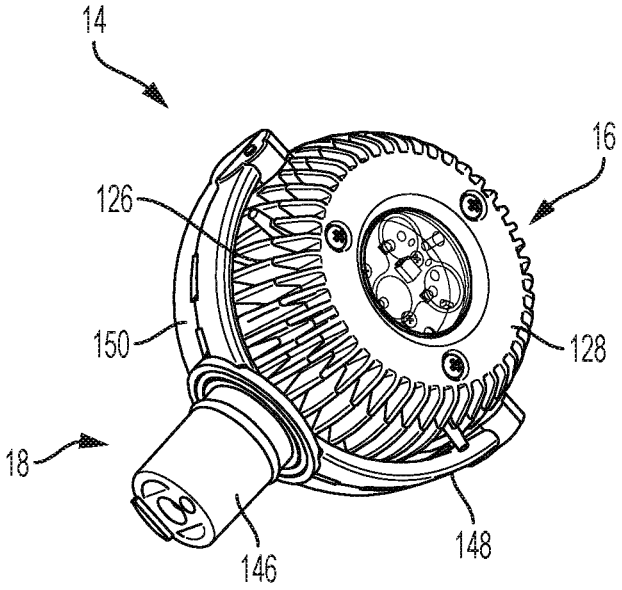
FIG. 24 is a front perspective view of an exemplary lamp assembly.
Figure 25:
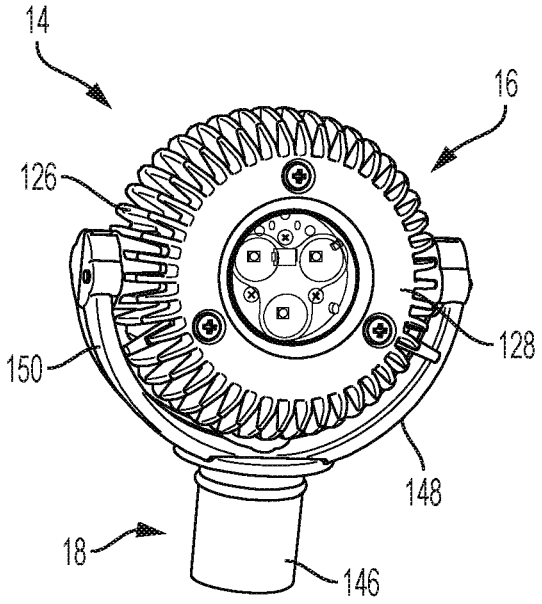
FIG. 25 is another front perspective view of FIG. 24.
Figure 26:
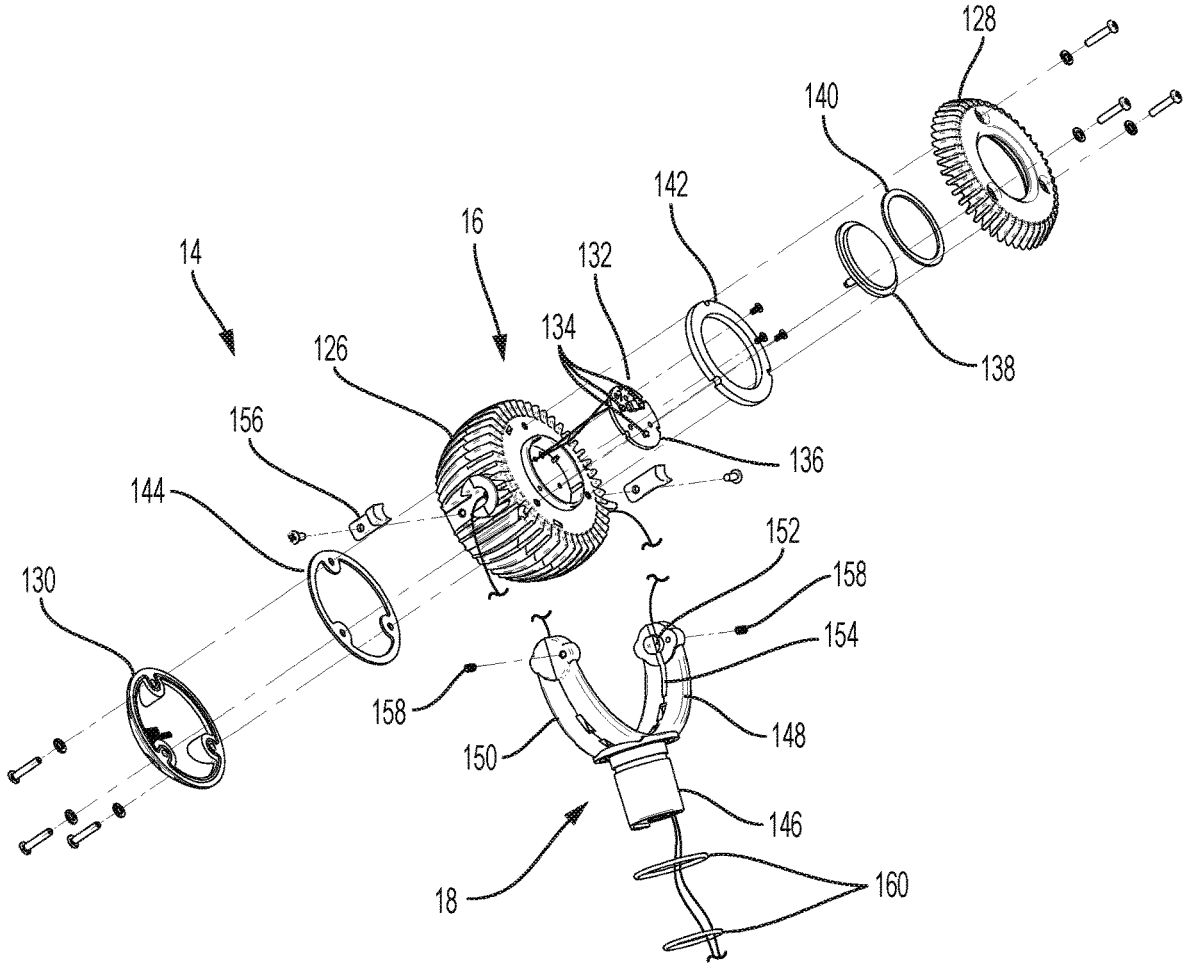
FIG. 26 is an exploded view of FIG. 24.
Figure 27:
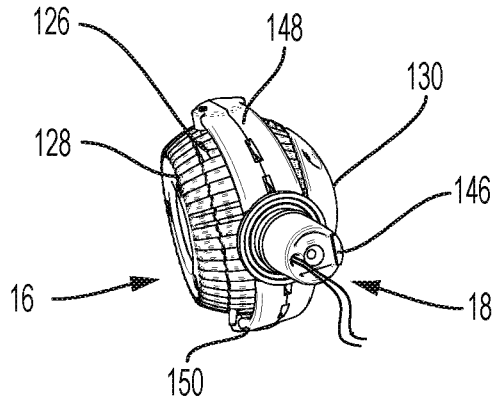
FIG. 27 is a bottom perspective view of FIG. 24.
Figure 28:
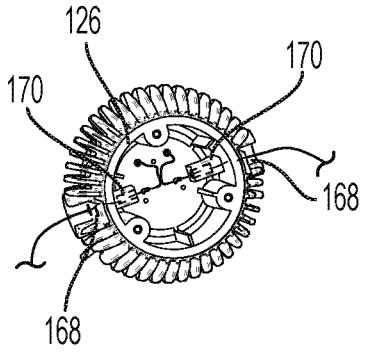
FIG. 28 is back perspective view of an exemplary lamp head body with conductors.
Figure 29:
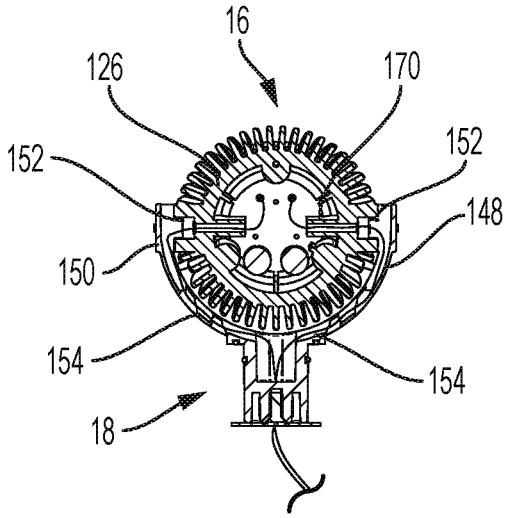
FIG. 29 is a back, sectional view of FIG. 24 taken through a mid-point of the lamp assembly.
Figure 30:
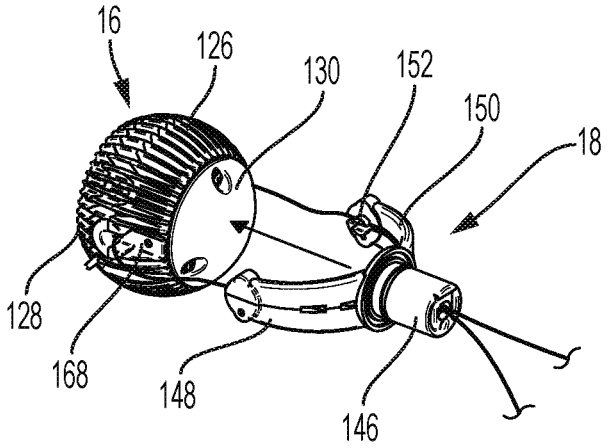
FIG. 30 is a back perspective view of the exemplary lamp assembly with the lamp head disassembled from the lamp support.
Figure 31:
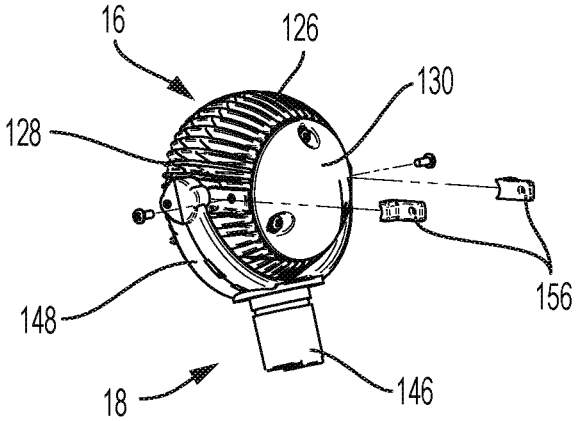
FIG. 31 is a back perspective view of the exemplary lamp assembly with exemplary support locks.
Figure 32:
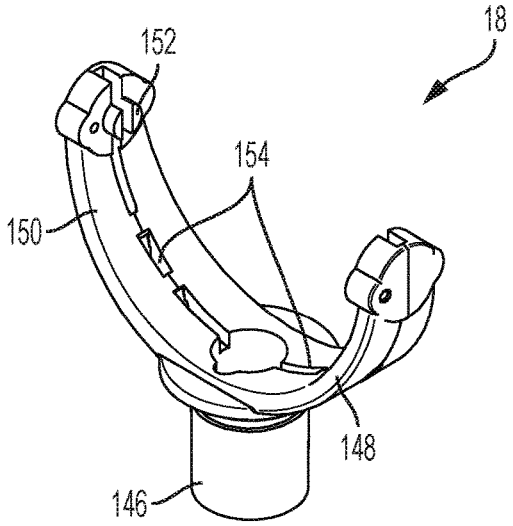
FIG. 32 is a top perspective view of an exemplary lamp support.
Figure 33:
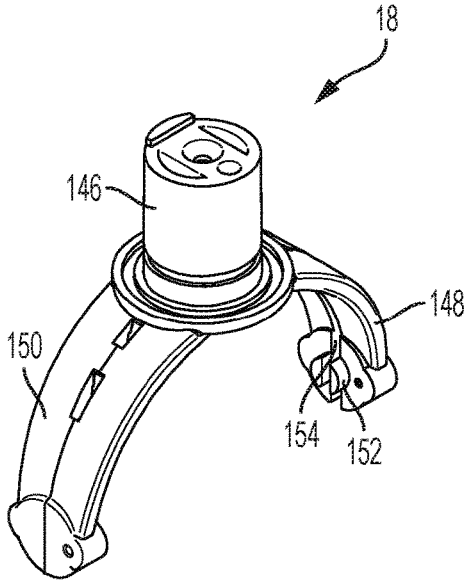
FIG. 33 is a bottom perspective view of an exemplary lamp support.
Figure 34:
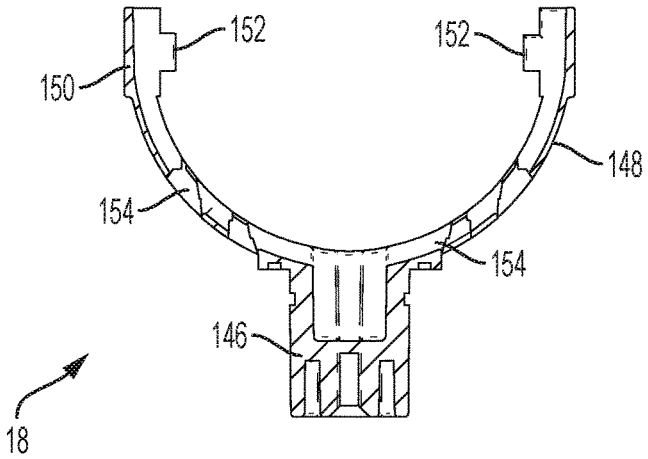
FIG. 34 is a front, sectional view of FIG. 32 taken through the mid-point of the exemplary lamp support.
Figure 35:
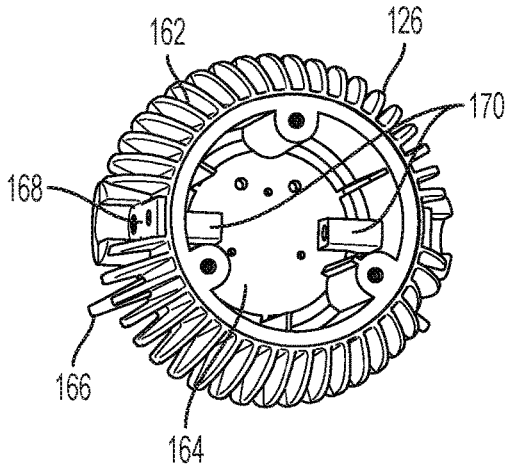
FIG. 35 is a front perspective view of an exemplar lamp body.
Figure 36:
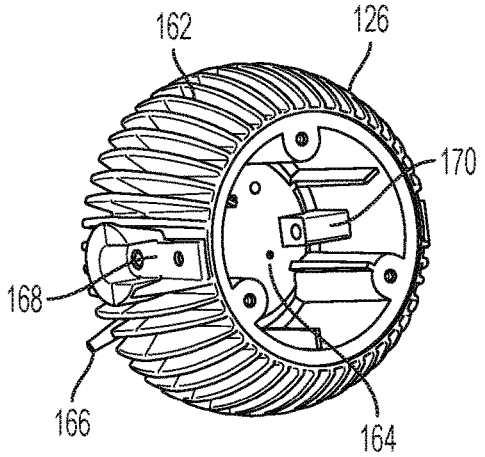
FIG. 36 is another front perspective view of FIG. 35.
Figure 37:
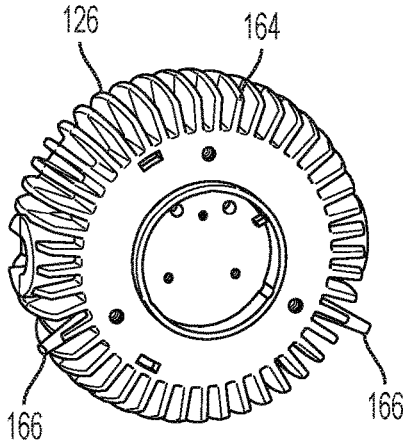
FIG. 37 is a back perspective view of FIG. 35.
Figure 38:
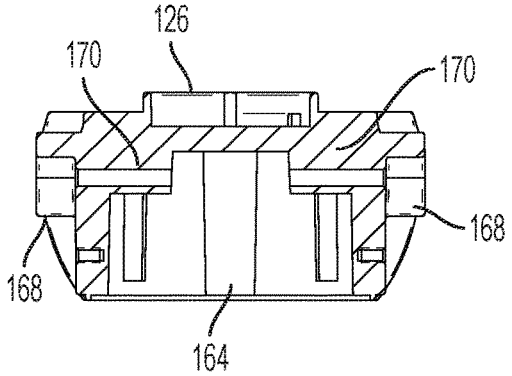
FIG. 38 is a top, sectional view of FIG. 35 taken through a mid-point of the exemplary lamp body.

As shown in FIGS. 21-23, the second lower cover 100 is used in connection with a mounting plate 110 that attaches to the base 20 and receives the lamp assemblies 14. The mounting plate 110 includes an outer surface 112 and an inner surface 114. One or more projections 116 extend from the inner surface 114 to assist with connecting the mounting plate no to the base 20, for example by engaging the clips 55. First and second shaft openings 118 are provided in the mounting plate 110 having a cylindrical wall that extends from the inner surface 114. The shaft openings 118 rotatably receive the lamp assemblies 14. A stop 120, for example a substantially T-shaped projection extends from the inner surface 114. The stop 120 coordinates with anti-rotation brackets 84 of the lamp assemblies 14 to limit rotation. A groove 122 is formed in the outer surface 112 around each of the shaft openings 118. Slots 124 extend through the mounting plate to receive the mounting posts 54 of the base 20 and allow the second lower cover 100 to be fastened to the mounting posts 54.

FIGS. 24-31 show an exemplary embodiment of a lamp assembly 14. The lamp assembly 14 includes a lamp head 16 pivotably connected to a lamp support 18. The lamp head 16 includes a lamp body 126, a front cover 128, and a back cover 130. The body 126 retains an LED board 132, having one or more LEDs 134 connected to a printed circuit board (PCB) 136. A lens 138 is positioned between the body 126 and the front cover 128. A first gasket 140 and a second gasket 142 can be positioned around the lens 138. A third gasket 144 can also be positioned between the body 126 and the back cover 130. The lamp support 18 includes a stem 146, a first arm 148, and a second arm 150. The first and second arms 148, 150 each include a connecting projection 152. In an exemplary embodiment, the connecting projecting 152 has a first and second portion separated by a gap so that the projection can flex inwardly and snap fit to a recess in the body 126.

As best shown in FIGS. 29-34, the first and second arms 148, 150 include conductor conduits 154 for feeding conductors to the body 126. A positive and negative conductor can be fed through the stem 146 with a first conductor traveling through the first arm 148 and a second conductor traveling through the second arm 150. The conductors are feed through the stem 146 and the lamp body 126 to connect to the PCB 136. By separating the conductors, the lamp head 14 can rotate with respect to the support 18 and to the base 20 without risk of tangling or damaging the conductors. A pair of support locks 156 can be connected to the body 126 to prevent the lamp support 18 from separating from the lamp head 16. One or more fastening elements can be used to retain the lamp head 16 in a set position respective to the support 18. As best shown in the exemplary embodiment of FIG. 26, one or more set screws 158 can extend through the first and second arms 148, 150. The set screws 158 can be tightened by a user after a desired position of the lamp head 16 has been established. The stem 146 can also include one or more gaskets or seals 160, for example O-rings that help to prevent fluid from entering the housing 12.

Figure 39:
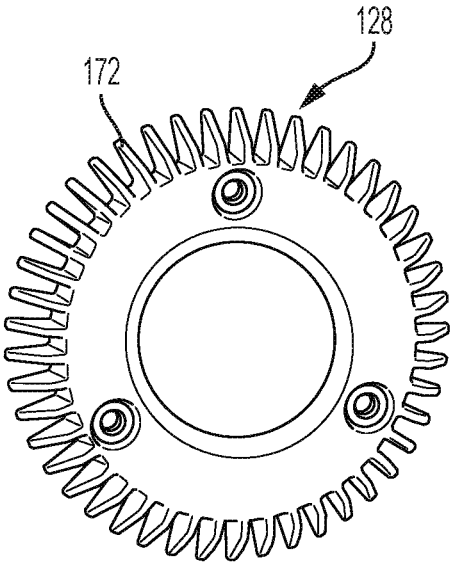
FIG. 39 is a front perspective view of an exemplary front cover.
Figure 40:
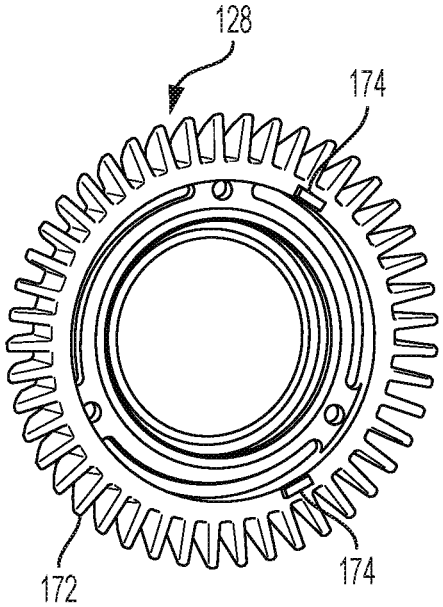
FIG. 40 is a back perspective view of FIG. 39.
Figure 41:
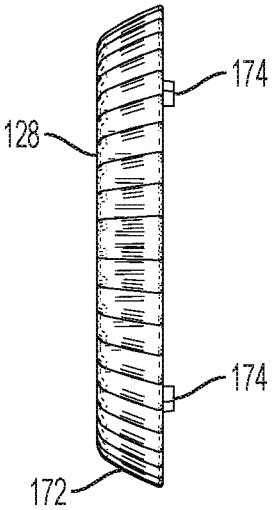
FIG. 41 is a side view of FIG. 39.
Figure 42:
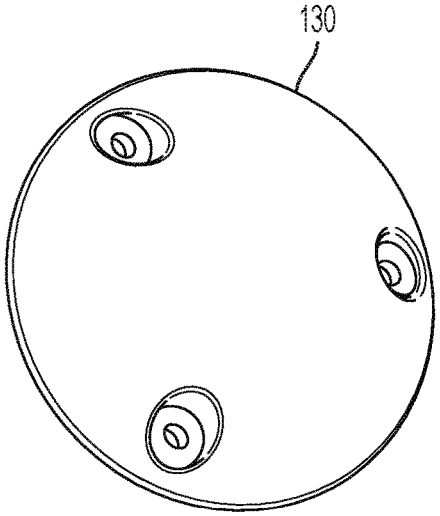
FIG. 42 is a back perspective view of an exemplary back cover.
Figure 43:
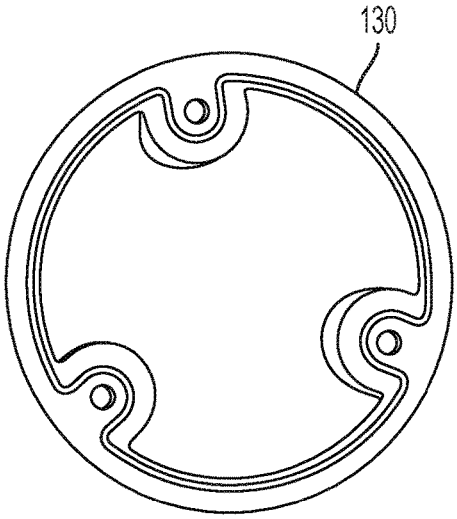
FIG. 43 is a front perspective view of FIG. 42.
Figure 44:
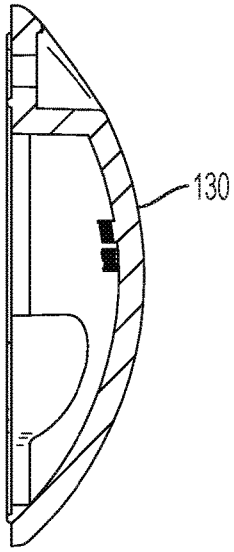
FIG. 44 is a side, sectional view of FIG. 42 taken through a mid-point of the exemplary back cover.

FIGS. 35-44 show an exemplary embodiment of a body 126, front cover 128, and back cover 130. The body 126, front cover 128, and back cover 130 combine to form a substantially spherical lamp head 16. As shown in FIGS. 35-38, the body 126 includes one or more fins 162 extending from an outer surface and a central chamber 164. A first and second pin 166 extends from the body 126. The first and second pins 166 engage the first and second arms 148, 150 of the lamp support 18 to act as rotational stops. A first and second groove 168 is positioned on sides of the body 126 to slidably receive the connecting projections 152 of the first and second arms 148, 150. As shown in FIGS. 39-41, a first post and a second post 170 extend into the body 126 having a conductor channel. The front cover 128 has one or more fins 172 extending around an outer surface to dissipate heat from the lamp head 16. The fins 172 can be substantially aligned with fins 162 on the body 126. A set of tabs 174 extends from the front cover to assist in retaining and aligning the front cover 128 to the body 126. In an exemplary embodiment, the front cover 128 and the body 126 include metal, for example aluminum, and the rear cover includes a polymer, for example polycarbonate.

Figure 45:
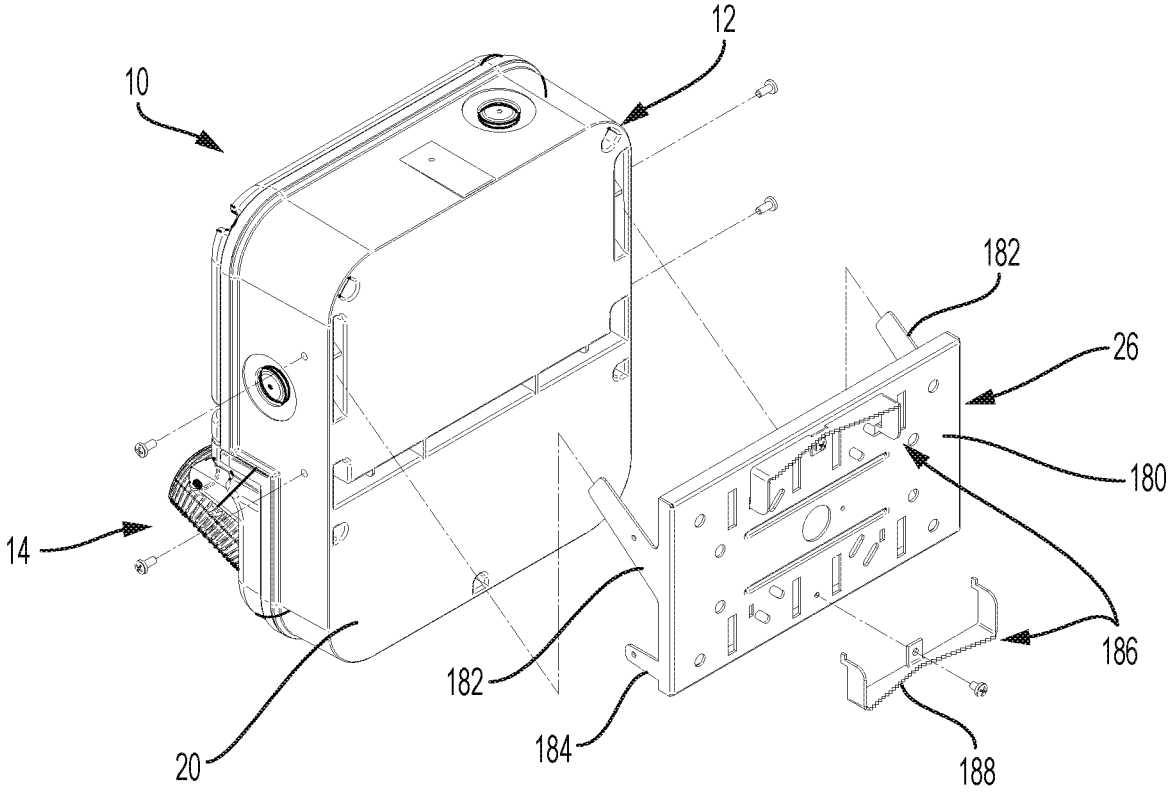
FIG. 45 is a back perspective, partially exploded view of an exemplary lighting unit and exemplary mounting bracket.
Figure 46:
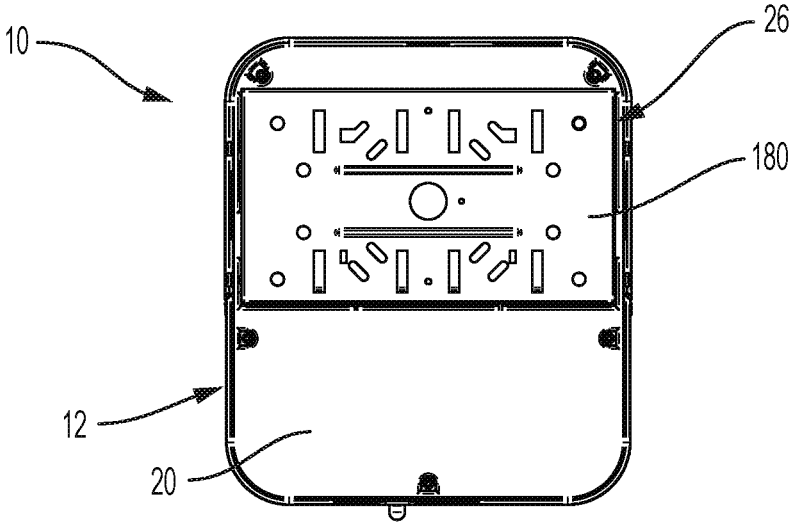
FIG. 46 is a back view of FIG. 45 with the exemplary mounting bracket attached.

FIGS. 45 and 46 show and exemplary embodiment of a mounting bracket 26 connected to the housing 12. The mounting bracket 26 has a base 180 with a top arm 182 and a bottom arm 184 extending from each side of the base 180. The top and bottom arms 182, 184 extend into the rear of the housing 12 to connect the mounting bracket 26. The base 180 includes different sets of openings having different sizes, shapes, and orientations. These openings allow the mounting bracket 26 to be connected to variety of different surfaces using fasteners, straps, and/or other mounting features. For example, the mounting bracket 26 can be configured to attach directly to a wall, ceiling, J-box, pole or column. A top and bottom pole mount connector 186 can be attached to the mounting bracket 26. The pole mount connectors include a plurality of teeth 188 to assist in retaining the housing 12 in a desired position on a curved surface.

The foregoing detailed description of the certain exemplary embodiments has been provided for the purpose of explaining the principles of the disclosure and its practical application, thereby enabling others skilled in the art to understand the various embodiments and the various modifications that are suited to the particular use contemplated. This description is not necessarily intended to be exhaustive or to limit the disclosure to the exemplary embodiments described. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. An emergency lighting unit comprising:

a housing including a base having a first compartment and a second compartment;

a first cover positioned over the first compartment;

a mounting plate positioned over the second compartment;

a second cover positioned over the second compartment and the mounting plate;

a lamp support rotatably connected to the mounting plate and extending through the mounting plate into the second compartment; and a lamp head rotatably connected to the lamp support, wherein the rotation of the lamp support is limited by the engagement of an anti-rotation bracket and a stop and wherein the stop is formed on the mounting plate, and wherein the anti-rotation bracket includes a fastener opening configured to receive a fastener and a conductor opening configured to receive an electrical conductor, the conductor opening spaced apart from the fastener opening.

2. The emergency lighting unit of claim 1, wherein the second cover encloses the lamp support and lamp head.

3. The emergency lighting unit of claim 1, wherein the anti-rotation bracket is connected to the lamp support and includes a disk and a projection.

4. The emergency lighting unit of claim 1, wherein the lamp support includes a stem, a first arm, and a second arm and the first arm and the second arm each include a conduit for receiving a conductor.

5. The emergency lighting unit of claim 1, further comprising a mounting bracket including an arm obliquely extending from a base, the arm being received in a depression in the housing having an angled side wall.

6. The emergency lighting unit of claim 1, wherein the fastener opening is fully defined by the anti-rotation bracket, and the conductor opening is partially defined by the anti-rotation bracket.

7. The emergency lighting unit of claim 1, wherein the fastener is configured to extend through the fastener opening and connect the anti-rotation bracket to the lamp support.

8. The emergency lighting unit of claim 1, wherein the mounting plate includes an opening to receive the lamp support, the stop positioned radially outside of the opening.

9. The emergency lighting unit of claim 1, wherein the stop is a substantially T-shaped projection.

10. A lighting unit comprising:

a housing including a base having a compartment;

a mounting plate positioned over the compartment;

a lamp support rotatably connected to the mounting plate having a stem, a first arm, and a second arm;

a lamp head rotatably connected to the first and second arms;

a set screw extending through the first arm to selectively engage the lamp head and retain the lamp head in a set angular position;

a first conductor passing from the first arm into the lamp head; and a second conductor passing from the second arm into the lamp head, wherein the stem includes a first conduit for receiving the first conductor and the second conductor, and wherein the rotation of the lamp support is limited by the engagement of an anti-rotation bracket and a stop and wherein the stop is formed on the mounting plate, and wherein the anti-rotation bracket includes a fastener opening configured to receive a fastener and a conductor opening configured to receive an electrical conductor, the conductor opening spaced apart from the fastener opening.

11. The lighting unit of claim 10, wherein the first arm and the second arm each include a second conduit for receiving the respective conductors.

12. The lighting unit of claim 10, wherein the first and second arms include a connecting projection and the lamp head includes a groove for receiving the connection projection.

13. The lighting unit of claim 12, wherein a support lock is connected to the groove to retain the lamp support.

14. The lighting unit of claim 10, wherein the lamp head includes a body, a front cover, and a back cover.

15. The lighting unit of claim 10, wherein the first and second conductors extend into the lamp head along the axis of rotation relative to the lamp support.

16. A lighting unit comprising:

a housing including a base having a compartment;

a mounting plate positioned over the compartment;

a lamp support rotatably connected to the mounting plate;

a lamp head rotatably connected to the lamp support, the lamp head comprising a body, a front cover and a back cover, wherein the body includes a front side and a back side, the front cover connected to the front side of the body, and the back cover connected to the back side of the body; and a light emitter assembly positioned in the body, wherein the lamp head includes a pin that is integrally formed with and extends from the body outwardly toward the lamp support, and wherein the lamp head and the pin rotate through an angle between a first position and a second position, and wherein the pin engages the lamp support to at the second position to limit rotation of the lamp head with respect to the lamp support, and wherein the rotation of the lamp support is limited by the engagement of an anti-rotation bracket and a stop and wherein the stop is formed on the mounting plate, and wherein the anti-rotation bracket includes a fastener opening configured to receive a fastener and a conductor opening configured to receive an electrical conductor, the conductor opening spaced apart from the fastener opening.

17. The lighting unit of claim 16, wherein the body includes a first set of fins and the front cover includes a second set of fins aligned with the first set of fins.

18. The lighting unit of claim 16, further comprising a first gasket positioned between the front cover and the body and a second gasket positioned between the back cover and the body.

* * * * *